US009351524B2

(12) United States Patent
Buescher

(10) Patent No.: US 9,351,524 B2
(45) Date of Patent: May 31, 2016

(54) BRASSIERE ACCESSORY

(71) Applicant: Tracy Buescher, New York, NY (US)

(72) Inventor: Tracy Buescher, New York, NY (US)

( * ) Notice: Subject to any disclaimer, the term of this patent is extended or adjusted under 35 U.S.C. 154(b) by 115 days.

(21) Appl. No.: 14/166,026

(22) Filed: Jan. 28, 2014

(65) Prior Publication Data

US 2015/0208735 A1 Jul. 30, 2015

(51) Int. Cl.
*A41C 3/12* (2006.01)
*A41D 27/08* (2006.01)

(52) U.S. Cl.
CPC .. *A41C 3/12* (2013.01); *A41D 27/08* (2013.01)

(58) Field of Classification Search
CPC ..... A41C 3/00; A41C 3/02; A41C 3/12; A41F 3/00; A41F 1/006; A41F 17/00
USPC ..... 450/85–87; 2/326, 327, 336, 311, 312, 2/325, 338
See application file for complete search history.

(56) References Cited

U.S. PATENT DOCUMENTS

| | | | | |
|---|---|---|---|---|
| 1,849,321 | A | 3/1932 | Tomlinson | |
| 5,820,443 | A | 10/1998 | Burr | |
| 6,006,364 | A * | 12/1999 | Newsom et al. | 2/323 |
| 6,120,007 | A * | 9/2000 | Grant | 261/23.2 |
| 6,135,853 | A * | 10/2000 | Hopson | 450/86 |
| 6,698,030 | B2 * | 3/2004 | Cutler | 2/267 |
| 6,857,936 | B2 * | 2/2005 | Jones et al. | 450/86 |
| 6,872,119 | B2 * | 3/2005 | Brink | 450/86 |
| 7,278,900 | B1 * | 10/2007 | Ostaseski | 450/86 |
| 7,780,502 | B2 * | 8/2010 | Calamari et al. | 450/86 |
| 8,096,851 | B2 * | 1/2012 | Fine | 450/1 |
| 8,152,591 | B2 * | 4/2012 | De Sousa et al. | 450/1 |
| 8,257,139 | B2 * | 9/2012 | De Sousa et al. | 450/86 |
| 8,425,274 | B1 | 4/2013 | Ratcliff | |
| 2004/0007018 | A1 | 1/2004 | Detsis | |
| 2009/0126163 | A1 * | 5/2009 | Groner | 24/302 |
| 2009/0215360 | A1 * | 8/2009 | Brideson | 450/86 |
| 2010/0154472 | A1 | 6/2010 | Unitan | |
| 2010/0223713 | A1 | 9/2010 | DeSousa et al. | |

FOREIGN PATENT DOCUMENTS

| | | | |
|---|---|---|---|
| JP | H03280904 | A | 12/1991 |
| JP | 2011-024982 | A | 2/2011 |
| KR | 2012-0014989 | A | 2/2012 |
| WO | 2004/047584 | A1 | 6/2004 |

OTHER PUBLICATIONS

International Search Report and Written Opinion of the International Searching Authority dated May 28, 2015 of PCT/US2015/011492.

* cited by examiner

*Primary Examiner* — Gloria Hale
(74) *Attorney, Agent, or Firm* — Pearne & Gordon LLP

(57) ABSTRACT

A brassiere and a decorative element having a relatively flat configuration, a set of suspension straps symmetrically arranged about a vertical plane between the brassiere cups serving to locate the decorative element symmetrically about the vertical plane above, and free of contact with a bridge between the cups, the suspension straps on each side of the decorative element including a first suspension strap attached to a mid-section of an associated cup and to an adjacent side edge of the decorative element and a second suspension strap spaced above the first suspension strap and attached to said adjacent side edge of the decorative element, the first and second suspension straps being arranged to maintain a face of the decorative element facing in a direction to which said cups project.

4 Claims, 4 Drawing Sheets

BRASSIERE ACCESSORY

BACKGROUND OF THE INVENTION

The invention relates to ladies adornments and, more particularly, to a decorative element associated with a brassiere.

PRIOR ART

It is known, for example, from U.S. Pat. No. 8,425,274 and U.S. Patent Application Publication 2010/0154472 to associate a decorative element with a brassiere. Typically such elements are disposed at or form the bridge between the cups of the brassiere. As a result, the decorative element is not ordinarily displayed and, if revealed, it is not presented in a manner that obtains a prominence separate from the brassiere itself. While a necklace or chain provides a more noticeable display of a decorative element such as a pendant, any physical activity of the wearer can cause the pendant to swing and fall out of a blouse and become a distraction and/or become overturned.

SUMMARY OF THE INVENTION

The invention integrates a pendant or other decorative element with a brassiere to add fashion and distinctiveness to both of these combined elements. The inventive arrangement has the decorative element suspended in or above the space between the cups of the brassiere. The decorative element is suspended with horizontal straps that extend sideways to attachment points on the cups and, optionally, the shoulder straps of the brassiere. The suspension straps are vertically separated to allow them to maintain the decorative element in place without the risk of swinging or face reversal.

The invention may be applied to relatively inexpensive, broad appeal product lines as well as more exclusive product lines. In the lower price category, the decorative element can be, for example, made of molded plastic, non-precious metal, base metal with silver or gold plate or fabric. In the more expensive lines, the decorative element can be made, for example, of 14K or 18K gold, or sterling silver. The decorative element can be imprinted, stamped, cast or otherwise created with an image and/or can serve as a mounting for semi-precious or precious gems.

DESCRIPTION OF THE PREFERRED EMBODIMENTS

Figure 1:
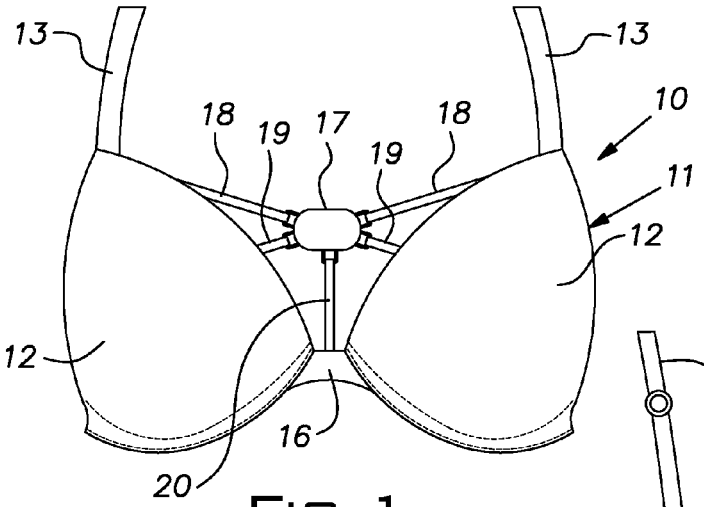
FIG. 1 is a front view of a first embodiment of a combined brassiere and decorative element.
Figure 2:
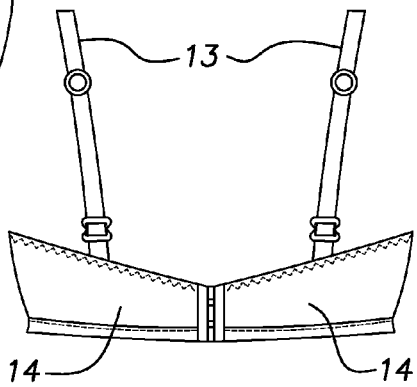
FIG. 2 is a rear view of the brassiere of FIG. 1.

Referring now to FIG. 1, there is shown a combined brassiere and decorative element 10. The brassiere or bra 11 as is typical has a pair of cups 12, shoulder straps 13 and backstraps 14, the latter being seen in FIG. 2. The cups 12 and straps 13, 14 are typically made of suitable fabric elements sewn together. Adjacent rim areas of the cups 12 are joined by a fabric band or bridge 16 sewn to each cup 12. The cups 12 project in a direction rising above the plane of the drawings of FIG. 1 and FIG. 7.

The decorative element, designated 17 and sometimes referred to simply as the element, is located so that it is symmetrical about a vertical plane centered between the cups 12 and is spaced above the bridge 16. The element or pendant 17 is kept in place by a set of fabric suspension straps or strands 18, 19 and 20 which in the showing of FIG. 1 are five in number. The straps include two lower pieces 18 and two upper pieces 19 extending inwardly from respective cups 12 and a single piece 20 extending upwardly from the bridge 16.

Figure 3:
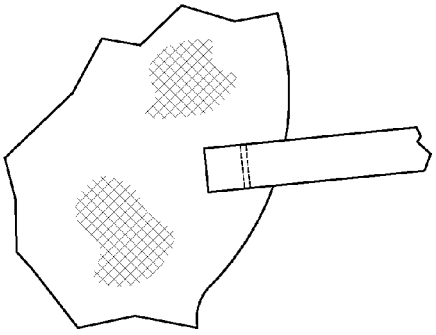
FIG. 3 is an enlarged view of one arrangement for attaching a decorative element suspension strap to the brassiere.

FIG. 3 shows a typical end of a suspension strap 18-20 distal from the element 17, fixed by sewing to respective areas of the cups 12 and bridge 16.

Figure 4:
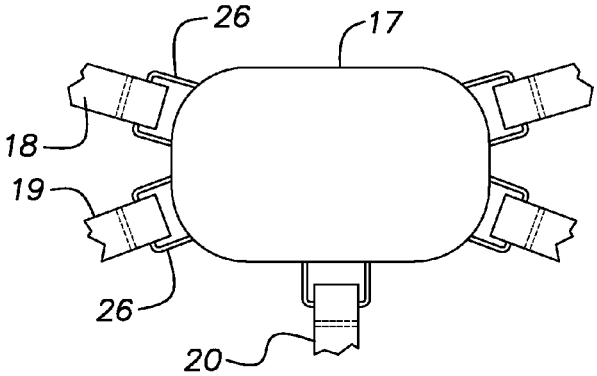
FIG. 4 is an enlarged front view of a decorative element and the attachment of the suspension straps thereto.

As seen in FIG. 4, ends of the suspension straps 18-20 adjacent the element 17 are passed through eyelets or loops 26 fixed to the element 17 at locations spaced about its periphery. Upper and lower side loops 26 extend sideways from each side edge of the element 17 and a fifth loop extends downwardly from a lower edge of the element. The support straps 18-20 are threaded through the element loops 26 and stitched down upon themselves.

The construction, as described, where the distal ends of the suspension straps 18-20 are sewn directly to the cups 12 is particularly suited for less expensive forms of the product 10.

Figure 7:
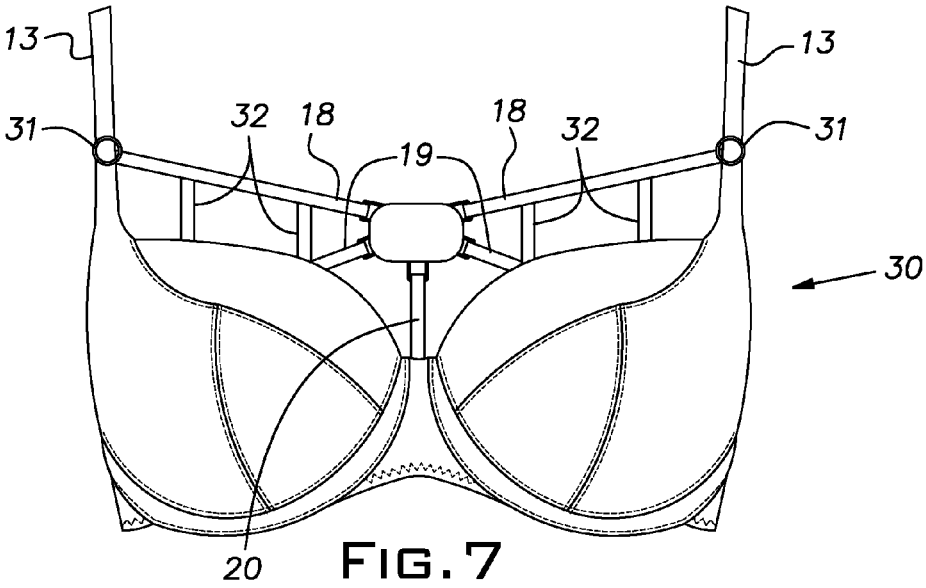
FIG. 7 is a second embodiment of a brassiere and decorative element.
Figure 8:
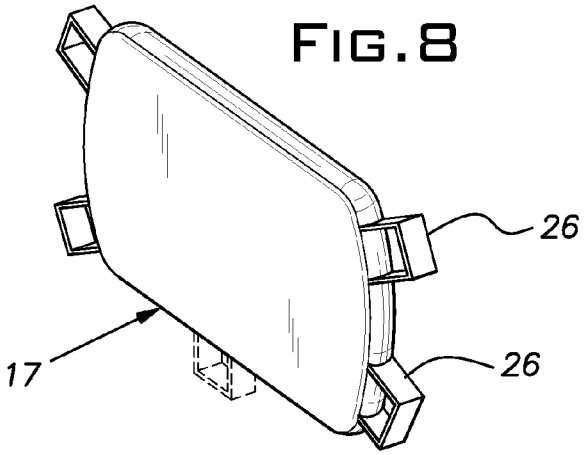
FIG. 8 is a perspective view of one form of decorative element.
Figure 11:
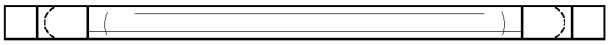
FIG. 11 is a top view of the decorative element of FIG. 8.
Figure 9:
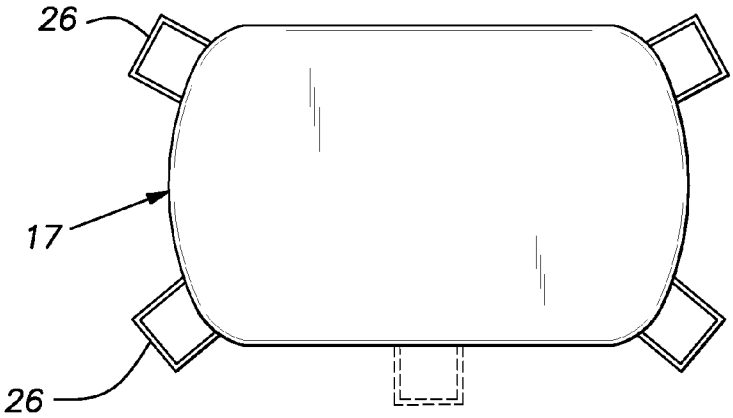
FIG. 9 is a front view of the decorative element of FIG. 8, the rear view being identical.
Figure 10:
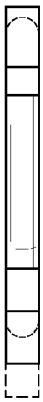
FIG. 10 is a side view of the decorative element, the opposite side being identical.
Figure 12:
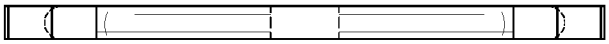
FIG. 12 is a bottom view of the decorative element of FIG. 8.
Figure 13:
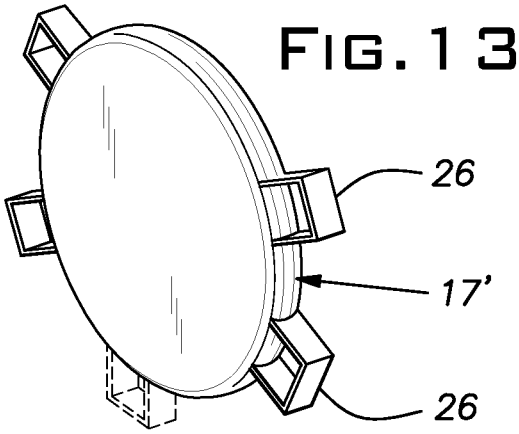
FIG. 13 is a perspective view of a second form of decorative element.
Figure 16:
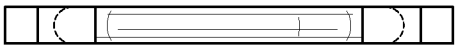
FIG. 16 is a top view of the decorative element of FIG. 13.
Figure 14:
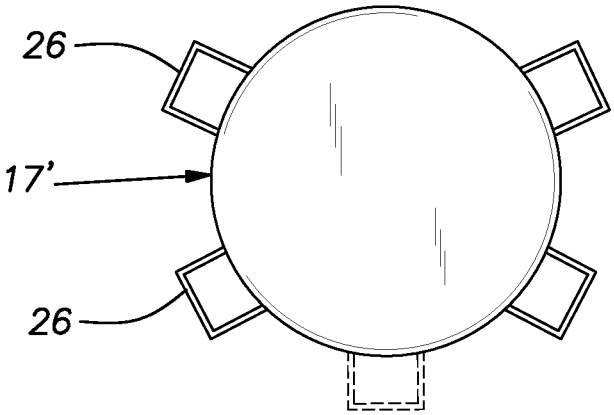
FIG. 14 is a front view of the decorative element of FIG. 13, the rear view being identical.
Figure 15:
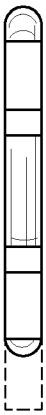
FIG. 15 is a side view of the decorative element, the opposite side being identical.
Figure 17:
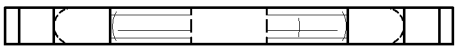
FIG. 17 is a bottom view of the decorative element of FIG. 13.

FIG. 7 illustrates a variant of the invention where a bra 30, constructed of fabric, has its upper sideways extending suspension straps 18 fixed to respective shoulder straps 13. In the illustrated case, the upper suspension straps 18 have their distal ends threaded through rings 31 of the shoulder straps 13 and stitched back down on themselves. Alternatively, where the rings 31 are not employed, the distal ends of the upper suspension straps 18 can be sewn directly to the shoulder straps 13. Auxiliary suspension straps 32 are shown extending from upper suspension straps 18 downwardly to respective cups 12; the ends of the auxiliary suspension straps 32 are stitched to an associated upper suspension strap 18 and a respective cup 12. It will be noted that the suspension straps 18-20, which normally will be ribbon-like in their cross-section, are somewhat more narrow and delicate than the shoulder straps 13.

Figure 5:
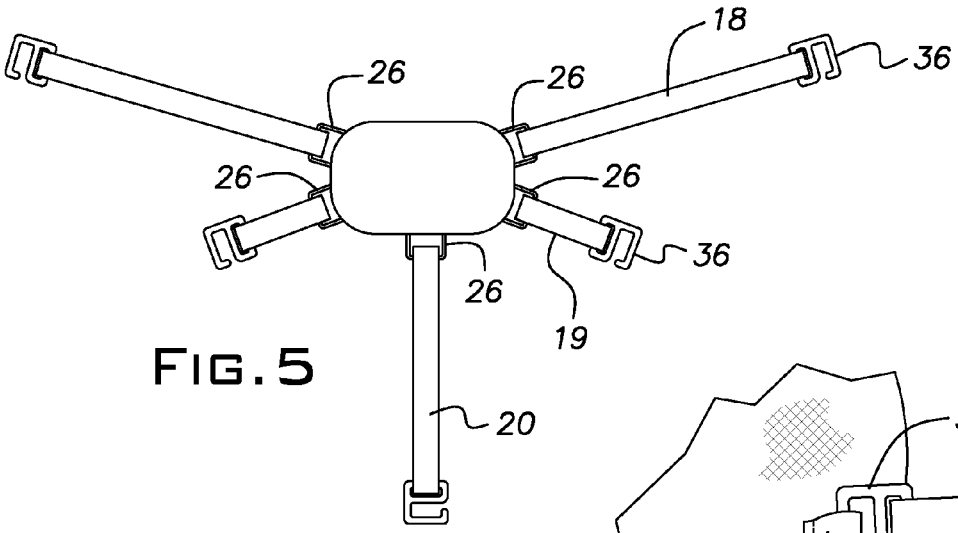
FIG. 5 is a front view of the decorative element and associated suspension straps removed from a brassiere.
Figure 6:
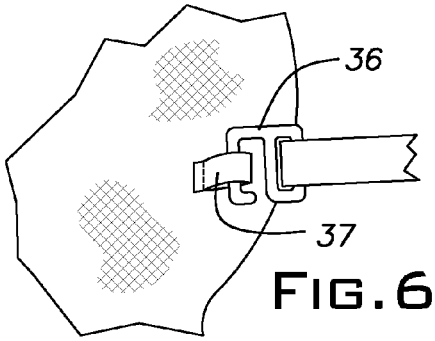
FIG. 6 is an enlarged view of a second arrangement for attaching a decorative element suspension strap to the brassiere.

Referring to FIG. 5, the distal ends of the suspension straps 18-20 can be fixed to plastic or metal hooks 36. FIG. 6 is a schematic showing of a fabric loop 37 that is sewn on a cup 12, the bridge 16 or a shoulder strap 13 at a desired location. A hook 36 is removably attached to a cup 12 or shoulder strap 13 by positioning it in the loop 37. Alternatively, a group of thread loops can be used in place of the fabric loop 37. Where the distal ends of the suspension straps 18-20 are provided with hooks 36 and the brassiere 11 with receptor loops 37, the decorative element 17 can be removed along with the suspension straps. This permits the bra 11 to be cleaned without risk that the decorative element 17 might be damaged, for example, by a cleaning detergent or that a gem or gems mounted on the element might be lost. Still further, the decorative element 17 can be fitted to another brassiere by simply reattaching the hooks 36 to the loops of the new bra 11.

FIGS. 8-12 illustrate physical details of the decorative element 17. The lower loop or eyelet 26, shown in dotted line in FIGS. 9 and 12, can be omitted along with the strap 20 for some applications. The element 17 may, for example, have a principal length, apart form the loops 26 of 2 inches and a height of 1.2 inches.

FIGS. 13-17 illustrate a variant of the decorative element 17'. The variant element 17' has four or five attachment loops 26 that have the same orientations as the loops of the element of FIGS. 8-12. The element 17' of FIGS. 13-17 can have a nominal diameter of 1.2 inches not including the loops 26.

The suspension straps 18-20 hold the element 17 above the bridge 16 so that it is visually distinguishable from the bra 11. The vertical spacing of the sideway extending straps 18-19 on each side of the element 17 prevents the element from turning inside face out.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, a brassiere and a decorative element, the brassiere having a pair of adjacent cups symmetrically disposed about a vertical plane, the cups each being supported by an associated shoulder strap and being mutually coupled by an intermediate bridge at the vertical plane, a set of suspension straps symmetrically arranged about said vertical plane serving to locate the decorative element symmetrically about the vertical plane above the bridge and free of contact with the bridge, the set of suspension straps having on each right and left side of the brassiere a suspension strap attached to a mid-section of a cup and to an adjacent side edge of the decorative element and another suspension strap spaced above the cup attached suspension strap attached to the decorative element substantially above a mid-height of the decorative element and inclined upwardly in a generally straight line, and an additional central bridge attaching suspension strap extending vertically from said bridge to said decorative element and attached therebetween to both said bridge and said decorative element, the cup attached and the another suspension straps being arranged to maintain a face of the decorative element facing in a direction to which said cups project.

2. The combination as set forth in claim 1, wherein said decorative element includes suspension strap receiving loops and said suspension straps are assembled through said loops and stitched down upon themselves.

3. The combination as set forth in claim 2, wherein ends of the suspension straps distal from the decorative element are stitched directly to the cups and/or shoulder straps.

4. The combination as set forth in claim 2, wherein the cups and/or shoulder straps include fabric or thread loops, the ends of the suspension straps distal from the decorative element being provided with hooks, each hook being received in a respective one of said fabric or thread loops.

* * * * *